United States Patent [19]

Zöller

[11] Patent Number: 4,610,830

[45] Date of Patent: Sep. 9, 1986

[54] PROCESS FOR CONTINUOUS PRODUCTION OF A FIBROUS, BONDED MATERIAL DIRECTLY FROM A POLYMERIC SOLUTION

[76] Inventor: Henry Zöller, Koppargatan 23, S-42171 Västra Frölunda, Sweden

[21] Appl. No.: 649,417

[22] Filed: Sep. 11, 1984

[30] Foreign Application Priority Data

Sep. 19, 1983 [SE] Sweden ..... 8305028

[51] Int. Cl.[4] ..... B01J 2/04; B01J 2/18; B29B 9/00; B06B 1/20

[52] U.S. Cl. ..... 264/9; 264/23; 264/115; 425/456

[58] Field of Search ..... 264/9, 23, 115; 425/456

[56] References Cited

U.S. PATENT DOCUMENTS

| | | | |
|---|---|---|---|
| 2,108,361 | 2/1938 | Asakawa | 264/23 X |
| 2,549,179 | 4/1951 | Delamare-Deboutteville X | 264/23 |
| 2,866,256 | 12/1958 | Matlin | 264/23 X |
| 2,954,271 | 9/1960 | Cenzato | 264/23 |
| 3,325,858 | 6/1967 | Ogden et al. | 264/9 X |
| 3,373,232 | 3/1968 | Wise et al. | 264/9 |
| 3,390,835 | 7/1968 | Harris | 264/9 X |
| 3,579,721 | 5/1971 | Kaltenbach | 264/9 X |
| 3,743,272 | 7/1973 | Nowotny et al. | 264/9 X |
| 3,985,841 | 10/1976 | Turnbull et al. | 264/9 |
| 4,104,341 | 8/1978 | Keppler et al. | 264/9 |
| 4,119,687 | 10/1978 | Resz et al. | 264/9 |
| 4,127,624 | 11/1978 | Keller et al. | 264/23 |
| 4,181,794 | 1/1980 | Kim et al. | 264/9 X |
| 4,198,461 | 4/1980 | Keller et al. | 264/23 |
| 4,324,751 | 4/1982 | Geyer, Jr. et al. | 264/23 |
| 4,375,347 | 3/1983 | Lombardo et al. | 264/9 X |
| 4,403,069 | 9/1983 | Keller et al. | 264/23 X |

FOREIGN PATENT DOCUMENTS

| | | | |
|---|---|---|---|
| 211828 | 12/1957 | Australia | 264/9 |
| 932246 | 8/1955 | Fed. Rep. of Germany | 264/9 |
| 2720701 | 11/1978 | Fed. Rep. of Germany | 264/9 |
| 847795 | 10/1939 | France | 264/23 |
| 1308528 | 9/1962 | France | 264/23 |
| 402312 | 6/1978 | Sweden . | |
| 429145 | 7/1967 | Switzerland | 264/9 |
| 2091303 | 7/1982 | United Kingdom | 264/9 |

*Primary Examiner*—Philip Anderson

[57] ABSTRACT

A process for continuous production of fibrous, bonded material directly from a polymeric solution, primarily characterized by the polymeric solution being fed through a flow duct in which the fibers are formed by subjecting the solution, during its passage through the duct, to turbulence vibrations and simultaneous cooling.

4 Claims, 3 Drawing Figures

Figure 1:
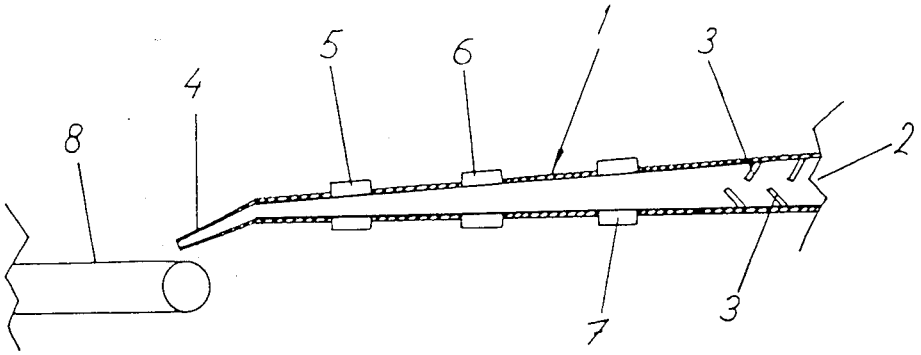

PROCESS FOR CONTINUOUS PRODUCTION OF A FIBROUS, BONDED MATERIAL DIRECTLY FROM A POLYMERIC SOLUTION

The present invention relates to a process for continuous production of a fibrous, bonded material directly from a polymeric solution.

The specific features of the large group of various materials referred to as "non-woven" are generally distinguished by the combination of fiber characteristics and bonding techniques.

The properties of the natural or synthetic polymer fibers constituting these materials are determined by the nature of the polymers, the molecular chain lengths and the degree of crystallinity as well as the orientation of the molecular chains.

Natural polymers exhibit a distinct orientation, whereas synthetic and natural, regenerated polymers such as cellulose in rayon are oriented by means of vigorous stretching after the polymer has been spun out in solution, melt etc.

A difference affecting the fiber characteristics is the fact that natural polymers are made up by uniting molecular chains to crystalline strands bonded in turn to microfibrils and fibers, whereas melt or solvent spun synthetic polymers exhibit no such inner structure.

The orientation of the molecular chains required for a specific strength, obtained by stretching the long fiber systems, cannot be achieved with short fibers such as fibrils of the synthetic pulp type which have been melt or solvent spun.

Also with so called spun-bonded fabric having fundamentally endless fiber lengths, the possibilities of achieving sufficient stretching are limited due to the difficulties in controlling the stretching while forming the fibrous web. Furthermore, the desirability of taking advantage of the self-bonding ability of the fibers for binding and fixing the fiber system will restrict the possibilities of stretching the fiber to its full extent.

The fiber systems can also be bonded mechanically by needling and chemically with the aid of binders as well as thermally by melting thermoplastic fiber material or special bonding fibers.

Common to the above-mentioned bonding processes is that the factor determining the material strength is the bonding, and not the nature of the fiber.

It is known that fibers are formed by suitably adapted agitation, stirring or vibration while simultaneously cooling a polymeric solution. The fibers are created by straightening the molecular chains in the solution producing in this way a continuous longitudinal polymerization as well as cross links between adjacent chains, fibrils etc. It has also been found that a morphologically advantageous fiber composition is achieved while simultaneously forming a bonded surface or volumetric structure in which the bindings have the same properties as the fibers in general. Fibers made up in this way will then be just as strong, or even stronger than a highly oriented natural or synthetic fibrous polymer material.

When agitating an object in a polymeric solution it is known that the fibers will be deposited on said object, and if the polymeric solution is agitated there is created a fiber collection which can be annular, plug-shaped or the like depending on the method of agitation.

When attempting to produce a continuous material having a width of 1 m or more from a polymeric solution by means of agitation, the use of a wire system is not recommended which is otherwise normal in web-forming processes. One reason is the difficulty of agitating the wire system, and another reason is the problems involved in removal of the final product from the wire. Fiber deposits would occur where undesirable, and this unintentional fiber collection would seriously disturb the manufacturing process.

The present invention, however, affords a process for rational, continuous production of a fibrous material from a polymeric solution.

The inventive process is primarily characterized in that the polymeric solution is fed through a flow duct in which the fibers are formed by subjecting said solution to vibrations and simultaneous cooling during its feed.

According to a particularly suitable embodiment of the invention, the polymeric solution is fed through at least one turbulence zone in the flow duct to create in this way polymeric nuclei as starting material for continued fiber formation downstream of said zone where the solution is subjected in one or more steps to vibration, preferably within the sonic frequency range, until the desired structure has been attained.

It has in fact been found that by direct agitation, including also turbulent flow, the initial fiber structure formation is accomplished more rapidly, whereas vibration within the sonic frequency range, for example, results in a slower but more advantageous fiber morphological construction.

Figure 2:
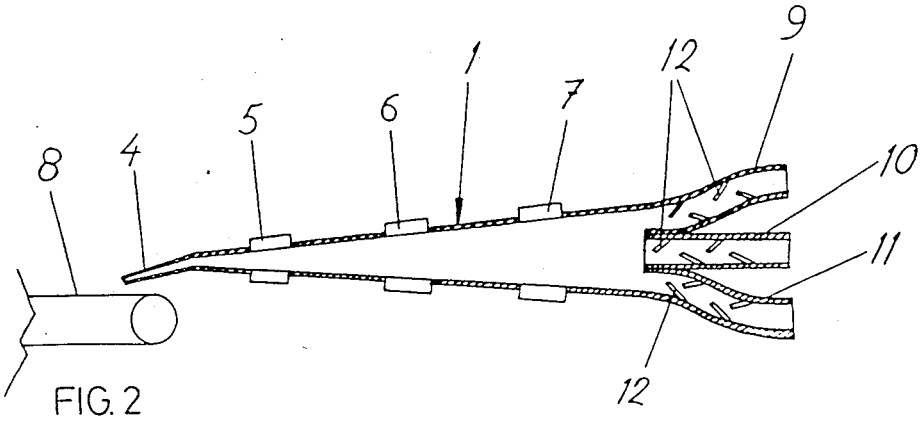
Figure 3:
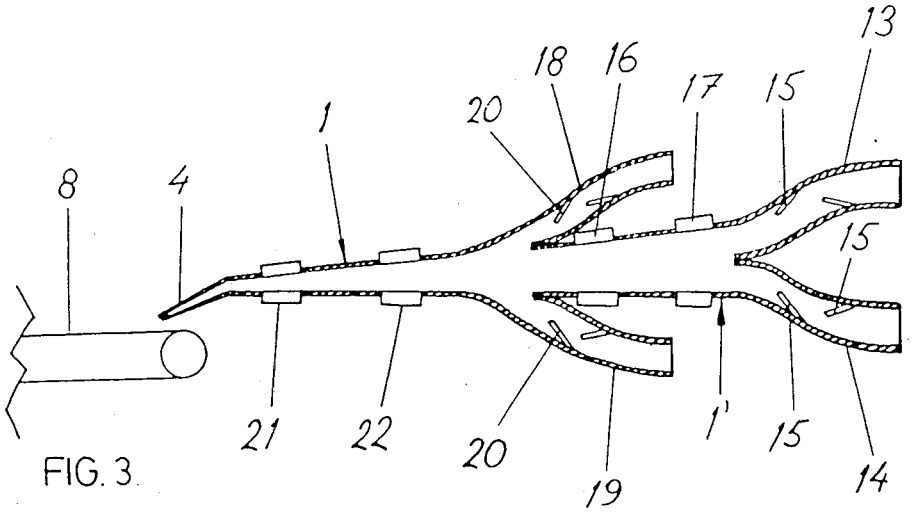

The invention process will be described in more detail below while referring to the accompanying drawing, in which FIGS. 1–3 illustrate schematically three different exemplary embodiments of the invention.

For carrying out the process according to the invention there is required, as indicated in all the drawing figures, a flow duct 1 for polymeric solution, said duct being shown in longitudinal section. According to the embodiment illustrated in FIG. 1, the duct inlet end is provided with a number of turbulence flanges 3, and along the extent of said duct there are disposed a number of vibrators 5, 6 and 7 directed towards the outlet end 4 and transmitting via membranes, not shown here, vibrations to the medium of the flow duct. As will be seen from the drawing, the duct 1 having rectangular cross section tapers continuously towards the outlet end 4, below which is disposed a wire 8.

A polymeric solution, fed into the inlet end 2 of the flow duct 1, has been heated to a temperature imparting to the polymer its optimum solubility. For polypropylene, this temperature may be 120° C. for example. At the flanges 3, the solution is subjected to a turbulence which enables rapid growth of small polymer chains serving as a base material for further fiber and structure formation. This process goes on while the solution flows past the vibration emitters 5, 6 and 7, which transfer vibrations within the sonic frequency range to the polymer solution. The vibration generators are suitably adapted to various frequencies for optimum fiber and structure formation. The polymeric solution is cooled during its passage through the flow duct, which is a prerequisite for the fiber formation. At the duct outlet end 4, a fibrous web is finally fed out onto the wire 8, which leads said web aside for further treatment.

Examples of polymers, useful for fiber and structure formation in accordance with the inventive process, are given in the two U.S. Pat. Nos. 4,127,624 and 4,198,461.

In the exemplary embodiment illustrated in FIG. 2, the flow duct 1 is provided with an inlet system having three inlet ducts 9, 10, 11, in which turbulence flanges 12 are disposed. In other respects the arrangement corresponds to that shown in FIG. 1. By arranging a plurality of inlet ducts wth turbulence flanges, the nucleus forming capacity in the polymeric solution can be increased while simultaneously enabling control of the through-flow conditions in the flow duct 1 by varying the flow rate, density, viscosity etc. in such a way that the fiber material formed is mainly transported in the center of the flow duct, which is the location of maximum vibration. Amongst other things, such flow conditions will reduce the risk of fiber deposits onthe duct walls.

In the exemplary embodiment illustrated in FIG. 3, the flow duct 1 is provided with two first inlet ducts 13, 14, having turbulence flanges 15. Polymeric solutions with different flow rate, density, viscosity etc. are fed through said inlet ducts permitting, as described above, control of the flow conditions in the forward portion 1' of the flow duct. Vibrators 16, 17 are accommodated in this forward portion 1' of the flow duct 1 for further fiber and structure formation. The arrangement according to FIG. 3, however, further includes second inlet ducts 18, 19 having turbulence flagnes 20, and through said second inlet ducts additional quantities of polymeric solution can be supplied to the material passing through the flow duct 1 and consiting of solution and fibers formed, the polymeric content dissolving phase of said material then being reduced due to the formation of fibers. Since the formation of fiber is an additive process, fresh prepolymerized polymeric solution can be added through the second inlet ducts 18, 19 in order to change the fiber and material structure and for obtaining a higher yield. Additional vibration emitters 21, 22 are disposed in the flow duct 1 downstream of said second inlet ducts. The design of the device illustrated in FIG. 3 with its second inlet ducts also allows for other substances such as hydrophilic fibers, activated carbon or any other material with absorption filtering characteristics to be added for obtaining alternative composite materials.

The invention is not restricted to the exemplary embodiments described above and illustrated in the drawing, but a plurality of modifications are conceivable within the scope of the following claims.

For example, the number of inlet ducts, turbulence flanges and vibrators can be varied.

The agitation frequencies are dependent on the type of polymers, degree of concentration and the advance of fiber growth, and therefore the frequencies of the different vibrators must be adapted accordingly. In normal cases, however, the vibration frequencies can be found within the sonic range, i.e. between 20 and 20,000 Hz.

What I claim is:

1. A process for continuous production of fibrous bonded material directly from a polymeric solution, comprising feeding a said solution through a flow duct, inducing turbulence in said solution through said duct, cooling the solution in the duct, subjecting the solution in the duct to vibrations after inducing said turbulence, and ejecting the solution from the duct.

2. A process as claimed in claim 1, in which said vibrations are in the sonic frequency range.

3. A process as claimed in claim 1, in which said turbulence is induced by passing the solution over flanges that protrude within the duct.

4. A process as claim in claim 1, and introducing the solution into the duct through a first inlet duct, and introducing into a second inlet duct a material of different composition containing solid particles.

* * * * *